United States Patent [19]

Snelling

[11] 4,294,534

[45] Oct. 13, 1981

[54] MULTIPLE FUNCTION REPRODUCTION APPARATUS

[75] Inventor: Christopher Snelling, Penfield, N.Y.

[73] Assignee: Xerox Corporation, Stamford, Conn.

[21] Appl. No.: 111,519

[22] Filed: Jan. 14, 1980

[51] Int. Cl.[3] ..... G03G 15/00

[52] U.S. Cl. ..... 355/3 R; 355/8; 355/77; 358/300; 430/31

[58] Field of Search ..... 355/3 R, 8, 11, 77; 346/153.1, 161; 358/300, 285, 286; 430/31

[56] References Cited

U.S. PATENT DOCUMENTS

| | | | |
|---|---|---|---|
| 3,051,044 | 8/1962 | McNaney | 355/11 X |
| 3,455,637 | 7/1969 | Howard | 350/96 X |
| 3,603,730 | 9/1971 | Weigl et al. | 250/211 X |
| 3,681,527 | 8/1972 | Nishiyama et al. | 355/3 R |
| 3,845,239 | 10/1974 | Granzow et al. | 178/7.6 X |
| 4,012,585 | 3/1977 | Chen | 358/285 |
| 4,015,081 | 3/1977 | Starkweather | 358/300 X |
| 4,042,962 | 8/1977 | Yamaji et al. | 358/300 |
| 4,046,471 | 9/1977 | Branham et al. | 355/14 R |
| 4,204,725 | 5/1980 | Distefano et al. | 358/300 X |
| 4,241,990 | 12/1980 | Fisli | 358/300 X |

FOREIGN PATENT DOCUMENTS 54-53915 4/1979 Japan .

OTHER PUBLICATIONS

*IBM Tech. Disc. Bull.*, "Triple Function Box", vol. 15, No. 10, Mar. 1973, p. 3259.

*Primary Examiner*—Richard L. Moses

[57] ABSTRACT

A triple function image processing system incorporating, for operation in a first COPY mode, a light/lens imaging system for imaging originals at a viewing station or platen to produce latent electrostatic images thereof on a photoconductive surface. The electrostatic images are developed and transferred to a copy substrate material as in conventional xerographic systems. A flying spot light beam is provided in a second WRITE mode, the flying spot beam writing images on the photoconductive surface in response to image signals input thereto. In this mode of operation, the beam impinges on the photoconductive surface at a location upstream of the developing device. And, in a third READ mode, the beam is impinged on the photoconductive surface downstream of the developing device to scan images developed on the photoconductive surface. The scattered light is collected and converted to image signals representative of the image scanned.

In an alternate embodiment, the flying spot beam impinges on the photoreceptor at a single location upstream of the developing device for both WRITE and READ modes. To preserve the developed image for scanning by the flying spot beam in the READ mode, the developing device and the image transfer and cleaning mechanisms are disabled until after the developed image has been scanned.

23 Claims, 7 Drawing Figures

← THIRD IMAGE READ MODE →

| | SYSTEM COMPONENT | FIRST DRUM CYCLE | SECOND DRUM CYCLE |
|---|---|---|---|
| 1. | IMAGING STATION 21 | ENABLED | DISABLED |
| 2. | SCANNING BEAM 161' | DISABLED | ENABLED |
| 3. | DEVELOPING MECHANISM 22 | ENABLED | DISABLED |
| 4. | TRANSFER CORONA MEANS 24 | DISABLED | ENABLED |
| 5. | CLEANING DEVICE 28 | DISABLED | ENABLED |
| 6. | CORONA CHARGING MEANS 20 | DISABLED | ENABLED |

FIG. 4

MULTIPLE FUNCTION REPRODUCTION APPARATUS

This invention relates to an image processing apparatus and method, and more particularly to a multiple function image processing apparatus and method.

Incorporation of a laser raster output scanner, termed a ROS herein, into a xerographic type copying apparatus to achieve dual function capability, namely, copying and raster printing from electronically encoded data, is disclosed by U.S. Pat. No. 4,046,471. Extension of this dual function concept to a triple function device by addition of apparatus to electronically read original documents is also known. A description to a device of this type is found in IBM Technical Disclosure Bulletin, pages 3259–3260 (March 1973) entitled "Triple Function Box". In the device depicted therein, the electronic reading function is performed by a raster input scanner, termed RIS herein, which scans the original document with a scanning laser beam. In the described device, both the ROS and RIS functions alternately share the same laser scanning subassembly on a demand basis.

Scanning of an original document with a laser beam has, however, certain disadvantages associated with it. One principal disadvantage is operator safety. As is understood, great care must be taken in handling lasers to prevent exposure of the user's eyes to the laser beam. In the aforedescribed system, the laser beam must be brought to the document viewing station or platen which is usually at or closely adjacent to the spot where the machine operator stands. Further, since the laser beam must either scan the platen or the document itself must be moved, some type of two-dimensional scanning motion must be provided for the laser beam.

Also, direct scanning of an original document with a monochromatic light introduces problems in color copyability. For example, if a red laser is used as the light source, the scanning system when scanning an original document directly is 'red blind' leading to a failure to reproduce those portions of the image on the original document that are in red. Further, since original documents are normally paper, diverse light reflections occur requiring that the light collection optics either subtend a large solid angle or employ highly sensitive detectors.

The invention relates to a copying apparatus having a movable photoreceptor, together with means to charge the photoreceptor in preparation for imaging, exposure means for exposing the charged photoreceptor to produce latent electrostatic images on the photoreceptor, developing means for developing the latent electrostatic images, and transfer means for transferring developed images from the photoreceptor to a copy substrate material operatively disposed in succession along the path of movement of the photoreceptor; a high intensity beam of electro-magnetic radiation; means to focus the beam onto the photoreceptor upstream of the developing means; scanning means astride the path of the beam for scanning the beam across the photoreceptor; and image reading means for converting scattered radiation from scanning a developed image on the photoreceptor with the beam to image signals representative of the developed images.

The invention further relates to an image processing method, comprising the steps of: producing a latent electrostatic image on a charged photoconductive surface by either exposing an original at a viewing station or scanning the photoconductive surface with a flying spot beam modulated in accordance with video image signals; developing the latent electrostatic image; inhibiting transfer of the developed image to enable the developed image to be scanned; scanning the developed image with the beam while the beam is unmodulated; and converting radiation from scanning the developed image with the beam to video image signals representative of the developed image scanned.

FIG. 4 is a chart outlining the processing steps in the embodiment shown in FIG. 3 when processing images in the third image read mode;

There is shown herein a multi-mode reproduction apparatus operable selectively in a COPY mode to xerographically make copies of original documents in the manner typical of xerographic copiers or machines, in a WRITE mode to xerographically produce copies from image signals input thereto using a flying spot type scanner, and in a READ mode to read images developed on the machine photoreceptor with the same flying spot scanner to produce image signals representative thereof and thereby convert the image to electronic signals.

FIG. 1 EMBODIMENT

Figure 1:
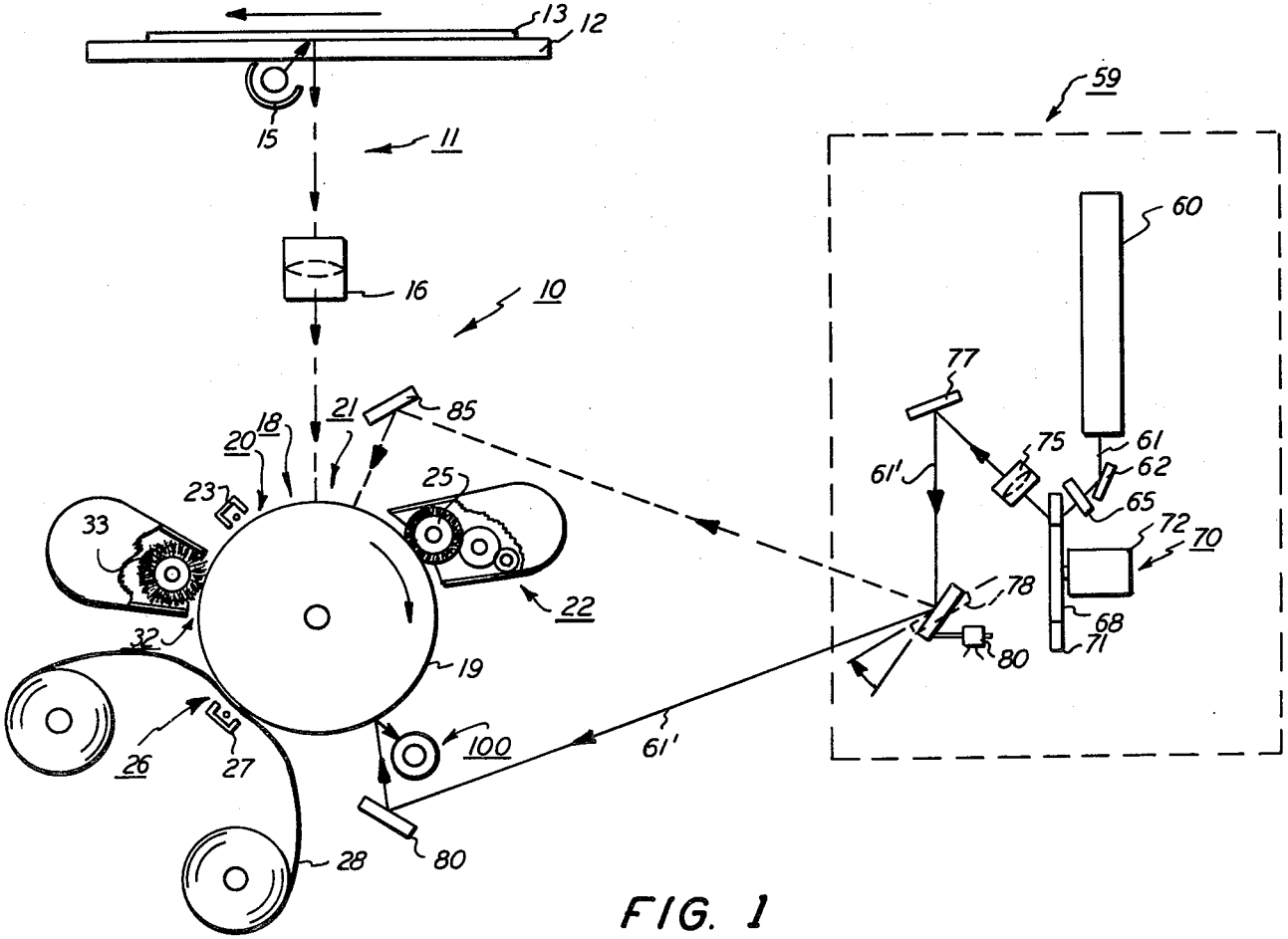
FIG. 1 is a schematic view showing an exemplary apparatus for carrying out multiple function image processing in accordance with the teachings of the present invention.
Figure 2:
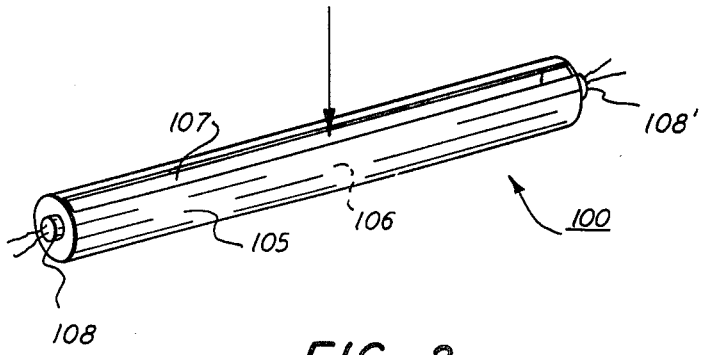
FIG. 2 is an isometric view showing details of the integrating cavity used in the apparatus shown in FIG. 1.

Referring now particularly to FIGS. 1 and 2 of the drawings, there is shown an exemplary xerographic type reproduction apparatus 10 incorporating the present invention. Xerographic reproduction apparatus 10 includes a viewing station or platen 12 where document originals 13 to be reproduced or copied are placed. For operation in the COPY mode as will appear more fully herein, a light/lens imaging system 11 is provided, the light/lens system including a light source 15 for illuminating the original 13 at platen 12 and a lens 16 for transmitting image rays reflected from the original 13 to the photoconductive surface 19 of drum 18 at exposure station 21.

Charging, developing, transfer, and cleaning stations 20, 22, 26, 32 respectively are disposed about drum 18 in operative relation thereto. Charging station 20 includes a corona charging means 23 for depositing a uniform electrostatic charge on the photoconductive surface 19 of drum 18 in preparation for imaging. A suitable developing mechanism, which may for example comprise a magnetic brush 25, is provided at developing station 22 for developing the latent electrostatic images created on drum 18.

At transfer station 26, corona transfer means 27 effects transfer of the developed image to a suitable copy substrate material 28. A suitable drum cleaning device such as a rotating cleaning brush 33 is provided at cleaning station 32 for removing leftover developing materials from the surface 19 of drum 18. Brush 33 may be disposed in an evacuated housing through which leftover developer materials removed from the drum surface by the cleaning brush are exhausted.

In the example shown, photoconductive surface 19 comprises a uniform layer of photoconductive material such as amorphous selenium on the surface 19 of drum 18. Drum 18 is supported for rotation by suitable bearing means (not shown). A suitable drive motor (not shown) is drivingly coupled to drum 18 and rotates drum 18 in the direction shown by the solid line arrow when processing copies.

When operating in the COPY mode, the photoconductive surface 19 of drum 20 is charged to a uniform level by corona charging means 23. Platen 12 and the original document 13 thereon is irradiated by light source 15, and light reflected from document 13 being focused onto the photoconductive surface 19 of drum 18 by lens 16 at exposure station 21. Platen 12 and the document 13 thereon are at the same time moved in synchronism with rotation of the drum 18. The light reflected from the original 13 selectively discharges the charged photoconductive surface in a pattern corresponding to the image that comprises the original document.

The latent electrostatic image created on the surface 19 of drum 18 is developed by magnetic brush 25 and transferred to copy substrate material 28 through the action of transfer corona means 27. Following transfer, the photoconductive surface 19 of drum 18 is cleaned by cleaning brush 33 to remove leftover developer material. A suitable fuser or fixing device (not shown) fixes the image transferred to copy substrate material 28 to render the copy permanent.

While a drum type photoconductor is illustrated other photoconductor types such as belt, web, etc. may be envisioned. Photoconductive materials other than selenium, as for example, organic may also be contemplated. And while a scan type imaging system is illustrated, other types of imaging systems such as full frame flash, may be contemplated.

The photoconductor may be opaque, that is impervious to light, or wholly or partially transparent. The exemplary drum 18 typically has an aluminum substrate which renders the drum opaque. However, other substrate materials such as glass may be contemplated, which would render drum 18 wholly or partially transparent. One organic photoconductive material consists of an aluminized mylar substrate having a layer of selenium dispersed in poly-N-vinyl carbazole with a transparent polymer overcoating containing a charge transport compound such as pyrene.

Xerographic reproduction apparatus 10 includes a flying spot scanner 59. Scanner 59 has a suitable flux source of electro-magnetic radiation such as laser 60. The collimated beam 61 of monochromatic radiation generated by laser 60 is reflected by mirror 62 to a modulator 65, which for operation in the WRITE mode, modifies the beam 61 in conformance with information contained in image signals input thereto, as will appear. Modulator 65 may comprise any suitable modulator, such as acousto-optic or electro-optic type modulators for imparting the informational content of the image signals input thereto to beam 61.

Beam 61 is diffracted by disc deflector 68 of a holographic deflector unit 70. Deflector 68 comprises a substantially flat disc-like element having a plurality of grating faces or facets 71 forming the outer periphery thereof. Deflector 68 which is preferably glass, is driven by motor 72. Preferably, deflector 68 is disposed so that light beam 61 is incident to the facets 71 thereof at an angle of substantially 45°. The diffracted scanning beam 61′ output by deflector 68 exits at a complementary angle.

The scanning beam 61′ output by deflector 68 passes to an imaging lens 75. As shown, lens 75 is located in the optical path between deflector 68 and mirror 77, lens 75 being of a diameter suitable to receive and focus the scanning light beam diffracted by facets 71 of deflector 68 to a selected spot in the focal plane proximate the surface 19 of drum 18, as will appear.

The scanning beam 61′ from lens 75 is reflected by mirror 77 to read/write control mirror 78. Mirror 78, when in the solid line position shown in the drawings, reflects beam 61′ to mirror 80 which, in turn reflects the beam to a location on the surface 19 of drum 18 downstream of developer 22.

In the case where the photoconductive material is opaque, light impinging on the surface 19 of drum 18 is scattered. In the case where the photoconductive material is transparent, the light is transmitted, depending on the degree of transparency of the photoconductive material through the photoconductive material to the drum interior. As will be understood, scattered light is composed of both specular and diffuse reflected light while transmitted light is composed of specular and diffuse transmitted light. The scattered or transmitted light from the photoconductive surface 19 of drum 18 and the developed image thereon is collected in integrating cavity 100, and there converted to image signals when operating in the READ mode, as will appear.

Read/write control mirror 78 is supported for limited movement between a read position (shown in solid line in the drawing) and a write position (shown in dotted line in the drawing). A suitable driving mechanism such as solenoid 80 is provided to selectively move the mirror 78 from one position to the other. Return spring means (not shown) may be provided to return mirror 78 to the original position upon deenergization of solenoid 80.

When in the WRITE position (the dotted line position), the scanning beam 61′ is reflected by mirrors 78,85 to a location on the surface of drum 18 upstream of developer 22.

Referring particularly to FIG. 2, integrating cavity 100 consists of elongated hollow cylindrical housing 105 disposed adjacent and in predetermined spaced relationship to the surface 19 of drum 18, housing 105 being supported such that the longitudinal axis of housing 105 substantially parallels the axis of drum 18. Housing 105 is provided with an elongated slit-like aperture 107 in the wall thereof opposite the photoconductive surface 19 of drum 18, housing 105 being located such that light scattered from the drum surface and the developed image thereon passes through aperture 107 into the interior 106 of housing 105. A pair of photodetectors 108,108′ are provided in housing 105 at the ends thereof, photodetectors 108,108′ generating signals in response to the presence or absence of light. To enhance the light responsiveness of housing 105, the interior wall 107 thereof is preferably finished with a highly reflective material such as a highly reflective lambertian coating.

It will be understood that where the photoconductive material is transparent, integrating cavity 100 is suitably supported within the interior of drum 18 to receive light transmitted through the photoconductive material.

OPERATION OF THE FIG. 1 EMBODIMENT

In the COPY mode, latent electrostatic images are formed on the photoconductive surface 19 of drum 18 through exposure of the document 13 on platen 12 as described heretofore. In the WRITE mode, latent electrostatic images are created on the charged photoconductive surface 19 of drum 18 by means of the flying spot scanner 59 in accordance with image signals input thereto. In this mode, solenoid 80 is energized to move control mirror 78 to the write position (the dotted line position shown in FIG. 1). In this position, mirrors 78,85 cooperate to reflect scanning beam 61' to a point on the surface 19 of drum 18 upstream of developing station 22. Modulator 65 modulates the light intensity of scanning beam 61' in accordance with the content of the image signals input thereto so that scanning beam 61' dissipates the electrostatic charge on the drum surface to create a latent electrostatic image representative of the image signals input thereto. The electrostatic latent image so created is thereafter developed by magnetic brush 25 and transferred to copy substrate material 28 by corona transfer means 27 at transfer station 26. Following transfer, the surface of drum 18 is cleaned by cleaning brush 33 as described.

In this mode, and in the image READ mode described below, deflector 68 is continually driven at substantially constant velocity by motor 72. In the WRITE mode, the image signal source is controlled so as to be synchronized with rotation of deflector 68. The rotational rate of xerographic drum 18 which determines the spacing of the scan line, is preferably synchronized to the signal source in order to maintain image linearity.

In the image READ mode, where it is desired to read original 13 and convert the content thereof to image signals, solenoid 80 is deenergized to place control mirror 78 in the read position (the solid line position shown in FIG. 1). In this position, mirror 78 cooperates with mirror 80 to reflect the scanning beam 61' to the surface 19 of drum 18 at a point downstream of developing station 22. As a result, scanning beam 61' scans across the surface of drum 18 and any image developed thereon.

In this mode, a latent electrostatic image of the original 13 on platen 12 is created on the surface 19 of drum 18 through exposure of the original 13 and subsequent development by magnetic brush 25 in the manner described heretofore. As the developed image is carried on drum 18 from developing station 22 to transfer station 26, the image is scanned line by line by the scanning beam 61'. The light from beam 61' is sensed by integrating housing 105 in accordance with the presence or absence of toner on the drum surface, it being understood that where the light beam strikes toner, the light is absorbed, whereas where the light beam strikes uncovered portions of the photoconductive surface 19 of drum 18, the light is scattered and reflected back by the photoconductive surface to integrating housing 105. The presence or absence of light in housing 105 is sensed by photosensors 108,108' to provide an analog image signal representative of the developed image scanned. Image signals output by photodetectors 108,108' may be used to produce additional copies of the original 13, or stored, or transmitted to a distant point, etc..

Following scanning, the developed image on drum 18 may be transferred to substrate material 28 in the manner described heretofore. Alternately, transfer may be dispensed with and the drum surface cleaned by cleaning brush 33.

FIGS. 3 AND 4 EMBODIMENT

Figure 3:
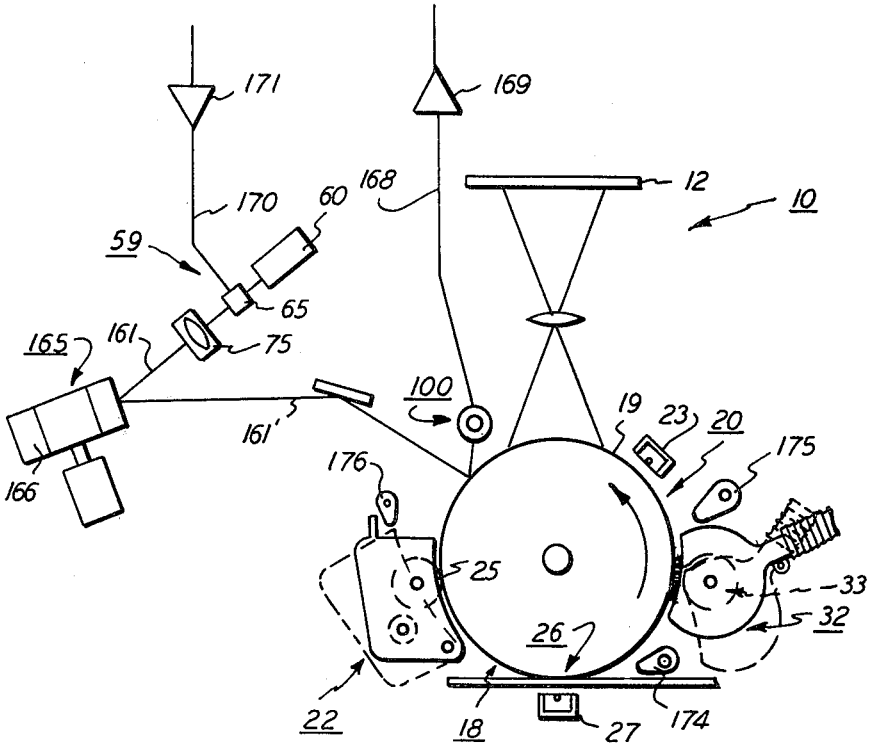
FIG. 3 is a schematic view of an alternate embodiment for carrying out multiple function image processing in accordance with the teachings of the present invention.

In the embodiment shown in FIGS. 3 and 4, where like numerals refer to like parts, a single scanning beam serves both to write images on the photoconductive surface 19 of drum 18 in the image WRITE mode and to read images developed on drum surface in the image READ mode. Referring thereto, a beam 161 is derived from laser 60 and passed via modulator 65 and lens 75 to a rotating scanning polygon 165. The scanning beam 161' reflected from the mirrored surfaces 166 of polygon 165 impinges at a moving spot on the surface 19 of drum 18 at a location upstream of developing station 22. Light collector 100 is spaced opposite the photoconductive surface 19 of drum 18 to receive scattered light reflected from the photoconductive surface 19 of drum 18 and the image developed thereon during the image READ mode. The image signals generated by photodetectors 108,108' are output to lead 168 and amplifier 169. Image signals are input to modulator 65 through lead 170 and amplifier 171 during operation in the image WRITE mode.

OPERATION OF THE FIGS. 3 AND 4 EMBODIMENT

During operation in the image READ mode, photoconductive drum 18 is cycled twice for each read operation. During the first cycle of drum 18, a latent electrostatic image is created on the photoconductive surface 19 of drum 18, normally through exposure of the original 13 on platen 12 as described heretofore. The latent electrostatic image is thereafter developed by magnetic brush 25. The developed image is carried on drum 18 past transfer station 26, cleaning station 32, charging station 20, and exposure station 21. On the second cycle of drum 18, as the developed image comes opposite scanning beam 161', the image is scanned. As described heretofore, light scattered by the photosensitive surface 19 of drum 18 is reflected to integrating cavity 100 and there passes through slot 107 into housing 105 thereof where the light is sensed by photodetectors 108,108'. Photodetectors 108,108' convert the reflected light into image signals representative of the developed image scanned. The image signals are output to lead 168.

To permit the developed image to pass transfer station 26 and cleaning station 32 unimpeded, transfer corona means 27 is inactivated and suitable means such as camming elements 174,175 are provided to move the copy substrate material 28 and cleaning brush 33 out of contact with the drum surface. Camming elements 174, 175 are activated in timed synchronism with rotation of drum 18 during the first drum cycle. It will be understood that corona generating means 20 and light/lens imaging system 11 are inactivated while the developed image moves therepast.

A camming element 176 may be similarly provided to move magnetic brush 25 out of contact with the surface of drum 18 during the second drum cycle to permit the previously developed image to pass thereby following reading thereof by scanning beam 161'. The developed image may thereafter be transferred to copy substrate material 28 following which the surface of drum 18 is cleaned by cleaning brush 33 as described heretofore. For this purpose, camming elements 174,175 are deactivated to return both the copy substrate material 28 and cleaning brush 33 into operative contact with the drum surface. Corona transfer means 27 is activated to transfer the developed image to copy substrate material 28. Alternately, transfer of the developed image may be omitted and the developed image cleaned by cleaning brush 33 or magnetic brush 25 may be suitably biased to remove and return toner from the image to the developer sump.

FIG. 5 EMBODIMENT

Figure 5:
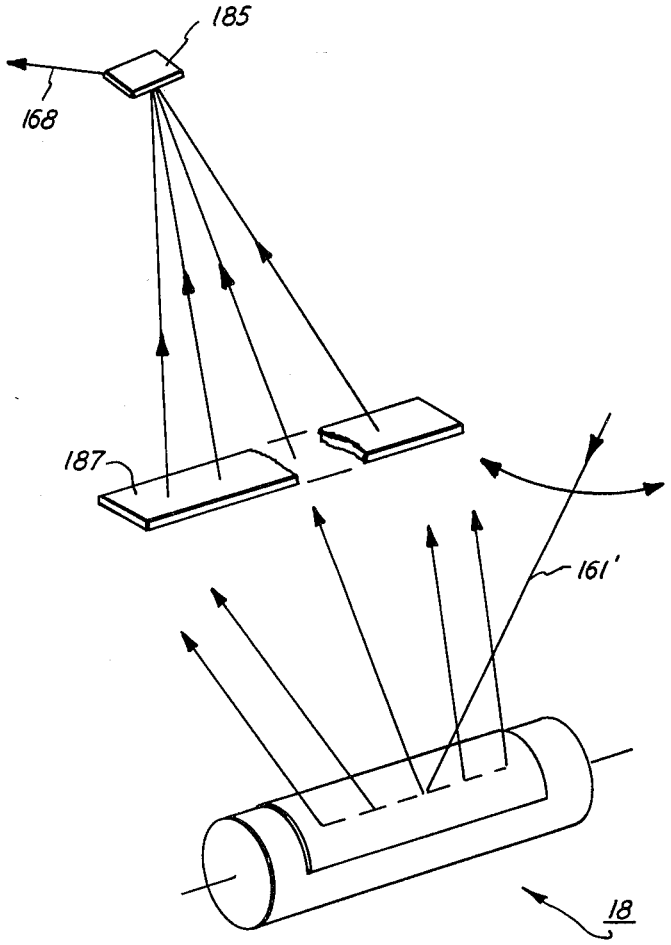
FIG. 5 is a schematic view of a second alternate embodiment for collecting reflected and scattered light in accordance with the teachings of the present invention.

Referring to the embodiment shown in FIG. 5, where like numerals refer to like parts, integrating cavity 100 is replaced by a single photodetector 185. To focus the divergent light reflections from the surface 19 of drum 18 onto photodetector 185 when operating in the image READ mode, a fresnel lens strip 187 is provided astride the path of scattered light reflected from the drum surface. Lens strip 187, the axis of which is substantially parallel to the axis of drum 18, has a length sufficient to receive light reflections as scanning beam 161' traverses from one end of drum 18 to the other.

As will be understood by those skilled in the art, lens strip 187 is of a type which focuses the divergent specular reflections from drum 18 to a common focal point. The photodetector 185 is suitably supported in predetermined spaced relationship to lens strip 187 at substantially the focal point thereof. The image signals from detector 185 are provided in output lead 168.

When operating in the image READ mode, beam 161' is scanned across the developed image on the surface 19 of drum 18 as described heretofore. Light reflections from the photoconductive drum surface as scanning beam 161 traverses back and forth, is focused by lens strip 187 onto photodetector 185 which converts the light reflections to image signals representative of the image scanned.

It will be understood that the aforedescribed multiple mode image processing system may also be operated advantageously to produce additional copies of an original 13 while at the same time permitting the platen 12 to be cleaned and a second original placed thereon. In this type of operation, the original 13 is first converted into image signals through operation of the system in the image READ mode described heretofore. The image signals created are stored, either temporarily or permanently in suitable memory (not shown) and thereafter used as the source for additional copies through operation of the system in the image WRITE mode. Following completion of the image READ mode and while additional copies of the original are being processed through the image WRITE mode, the original 13 may be removed from platen 12 and the next original to be copied or reproduced placed thereon.

FIG. 6 EMBODIMENT

Figure 6:
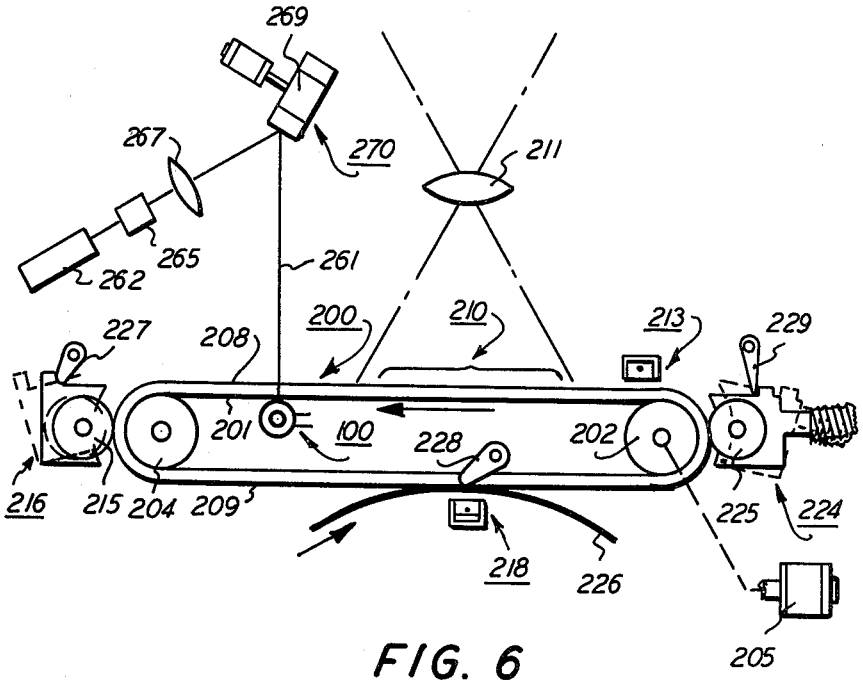
FIG. 6 is a schematic view of a third embodiment of the multiple function image processing apparatus of the present invention.

In the embodiment shown in FIG. 6 of the drawings, where like numerals refer to like parts, a photoreceptor 200 is thereshown in the form of an endless belt disposed about support rolls 202,204. Belt support roll 202 is drivingly coupled to a suitable drive motor 205, motor 205 when operated, moving belt 200 in the direction shown by the solid line arrow. Belt support roll 204 comprises an idler roll.

An exposure station 210 has light/lens imaging system 211 disposed opposite the upper run 208 of photoreceptor 200. A charging station 213 incorporating a suitable corona charging device is upstream of exposure station 210. A magnetic brush 215 is provided at a developing station 216 for developing the latent electrostatic images produced on photoreceptor 200, developing station 216 being disposed downstream of exposure station 212 and adjacent belt support roll 204.

A transfer station 218 is provided along the lower belt run 209 of photoreceptor 200, and downstream thereof, a cleaning station 224 having a cleaning brush 225 is provided opposite belt support roll 202. A suitable copy substrate material 226 receives developed images from photoreceptor 200 at transfer station 218.

Suitable separating means, exemplified herein by cams 227, 228, 229 are provided for disengaging magnetic brush 215, copy substrate material 226 and cleaning brush 225 respectively when operating in the image READ mode as will appear. For this purpose, the developing and cleaning station components may be supported for pivoting movement into and out of operative engagement with photoreceptor 200.

It will be understood that the various xerographic processing components described herein are exemplary only and other types and forms of such components may be envisioned.

A single scanning beam 261 is provided for both writing images on photoreceptor 200 in the image WRITE mode and for reading images developed on the surface of photoreceptor 200 in the image READ mode. Scanning beam 261 is derived from a suitable flux source such as laser 262. The beam 261 output by laser 262 passes via modulator 265 and lens 267 to the mirrored facets 269 of a rotating polygon 270. The beam is reflected by polygon 270 onto the upper belt run 208 of photoreceptor 200 at a point between exposure station 210 and developing station 216.

Photoreceptor 200 comprises any suitable photoconductive material which is at least partially transparent to light as for example, the exemplary organic photoreceptor described heretofore. And while photoreceptor 200 is illustrated in the form of an endless belt, other photoreceptor types such as replenishable web, drum, etc., may be contemplated.

In the embodiment shown, light collector 100 is disposed opposite the point where scanning beam 261' strikes photoreceptor 200, collector 100 being supported by suitable means (not shown) adjacent to and in predetermined spaced relationship to the interior side 201 of photoreceptor 200. The longitudinal axis of collector 100 is parallel to the line scanned by beam 261.

OPERATION OF THE FIG. 6 EMBODIMENT

In operation, in the COPY mode, a latent electrostatic image is created by light/lens imaging system 211 on the moving, previously charged surface of photoreceptor 200 through exposure of a document original (not shown). The image is thereafter developed by magnetic brush 215 and transferred to copy substrate material 226 at transfer station 218. Following transfer, photoreceptor 200 is cleaned by cleaning brush 225.

In the WRITE mode, scanning beam 261 writes latent electrostatic images on the previously charged photoreceptor 200 in response to image signals input to modulator 265. The electrostatic image is thereafter developed and transferred as described above. Following transfer, leftover developing materials are removed from photoreceptor 200 by cleaning brush 225.

In the image READ mode, developed images on photoreceptor 200 are scanned by scanning beam 261 on the second cycle of photoreceptor 200. To accommodate movement of the developed images past transfer and cleaning stations 218, 224, respectively, cams 228, 229 are actuated to separate copy substrate material 236 and cleaning brush 225 from photoreceptor 200 on the first cycle of photoreceptor 200. At the same time, the corona devices at transfer station 218 and charging station 213 are inactivated.

As the developed image passes the point where scanning beam 261 impinges on the photoreceptor 200, the developed image is swept by beam 261. As described, light is transmitted through the toner free portions of photoreceptor 200, the presence or absence of light being responded to by detectors 108,108' of collector 100 to produce analog image signals representative of the developed image scanned.

To permit the developed image to pass unimpeded past magnetic brush 215 after scanning, cam 227 is actuated to separate brush 215 from photoreceptor 200. Cams 228,229 are reset to enable transfer of the developed image to the copy substrate material 236 and removal of leftover developer materials from photoreceptor 200 by cleaning brush 225.

FIG. 7 EMBODIMENT

Figure 7:
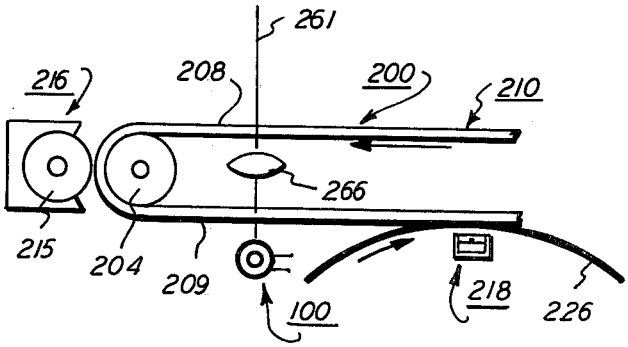
FIG. 7 is a schematic view of a fourth embodiment of the multiple function image processing apparatus of the present invention.

In the embodiment shown in FIG. 7, where like numerals refer to like parts, collector 100 is placed adjacent the lower belt run 209 of photoreceptor 200 and opposite the photoreceptor exterior surface. Suitable means (not shown) are provided for supporting collector 100 in predetermined spaced relation to photoreceptor 200. A suitable lens means 266 may be provided interiorly of photoreceptor 200 to maintain scanning beam 261 in focus following passage of the beam through the upper belt run 208 of photoreceptor 200.

Since, in this embodiment as will appear, only a single processing cycle is required for COPY, WRITE, and READ modes, cams 227,228,229 for separating magnetic brush 215, copy substrate material 226 and cleaning brush 225 from the photoreceptor surface may be dispensed with.

OPERATION OF THE FIG. 7 EMBODIMENT

Operation of this embodiment in both the COPY and image WRITE modes are the same as disucssed heretofore in connection with FIG. 6. In the image READ mode, developed images produced on photoreceptor 200 are scanned by scanning beam 261 looking through both upper and lower belt runs 208,209 of the photoreceptor. Light transmitted through the developed image on the photoreceptor lower belt run 209 is picked up by detectors 108,108' of collector 100 to produce image signals representative of the developed image scanned.

Following scanning, the developed image may be transferred to the copy substrate material 236 and the photoreceptor cleaned by cleaning brush 224 in the manner described heretofore.

Where desired, collector 100 may be offset from the point where scanning beam 261 impinges on photoreceptor 200 in either or both of the FIGS. 6 and 7 embodiments. In that circumstance, suitable mirror means may be provided to direct the beam as the beam emerges from either the upper belt run 208 (FIG. 6) or lower belt run 209 (FIG. 7) into aperture 107 of collector 100.

While a single source of electro-magnetic radiation, i.e. laser 60 is shown, it will be understood that independent radiation sources may instead be provided for image WRITE and READ modes. In that circumstance, the optical system shown herein would be suitably modified to provide an independent optical path for each light beam.

While the invention has been described with reference to the structure disclosed, it is not confined to the details set forth, but is intended to cover such modifications or changes as may come within the scope of the following claims:

I claim:

1. In a copying apparatus having a movable photoreceptor, together with means to charge said photoreceptor in preparation for imaging, exposure means for exposing said charged photoreceptor to produce latent electrostatic images on the photoreceptor, developing means for developing latent electrostatic images, and transfer means for transferring developed images from the photoreceptor to a copy substrate material, operatively disposed in succession along the path of movement of said photoreceptor, the improvement comprising:

a high intensity beam of electro-magnetic radiation;

means to focus said beam onto said photoreceptor upstream of said developing means;

scanning means astride the path of said beam for scanning said beam across said photoreceptor; and image reading means for converting scattered radiation from scanning a developed image on said photoreceptor with said beam to image signals representative of said developed image.

2. The apparatus according to claim 1 including image writing means for modulating said beam in accordance with image signals input thereto to produce latent electrostatic images on said photoreceptor in accordance with said image signals.

3. The apparatus according to claim 2 in which said image reading means includes means to recycle said photoreceptor to bring said developed image into scanning relationship with said beam.

4. The apparatus according to claim 3 in which said image reading means includes means for disabling said transfer means to permit unimpeded movement of said developed image past said transfer means and into scanning relationship with said beam.

5. The apparatus according to claim 4 in which said image reading means includes means for disabling said developing means to permit unimpeded movement of said developed image past said developing means.

6. The apparatus according to claim 5 in which said image reading means includes means for re-enabling said transfer means following movement of said developed image therepast to permit transfer of said developed image by said transfer means to said copy substrate material following scanning of said developed image by said beam.

7. The apparatus according to claim 3 including cleaning means for cleaning said photoreceptor, said image reading means including means to disable said cleaning means to permit unimpeded movement of said developed image past said cleaning means and into scanning relationship with said beam.

8. The apparatus according to claim 7 in which said image reading means includes means for re-enabling said cleaning means following movement of said developed image therepast to permit cleaning of said photoreceptor following scanning of said developed image by said beam.

9. The apparatus according to claim 3 including cleaning means for cleaning said photoreceptor, said image reading means including means to disable said transfer means and said cleaning means to permit unimpeded movement of said developed image past said transfer means and said cleaning means and into scanning relationship with said beam.

10. The apparatus according to claim 9 in which said image reading means includes means for re-enabling said transfer means and said cleaning means on movement of said developed image therepast to permit transfer of said developed image to said copy substrate material by said transfer means and cleaning of said photoreceptor by said cleaning means following scanning of said developed image by said beam.

11. The apparatus according to claim 3 including cleaning means for cleaning said photoreceptor;

said image reading means including means to disable said transfer means and said cleaning means to permit unimpeded movement of said developed image past said transfer means and said cleaning means prior to scanning of said developed image by said beam and to disable said developing means to permit unimpeded movement of said developed image past said developing means following scanning of said developed image by said beam.

12. In a copying apparatus having a photoreceptor, means to charge said photoreceptor in preparation for imaging, exposure means for exposing said charged photoreceptor to produce latent electrostatic images, developing means for developing said latent electrostatic images, and transfer means for transferring said developed images to copy substrate material, the improvement comprising:

a high intensity light beam;

means to focus said light beam onto said photoreceptor;

scanning means astride the path of said light beam for line scanning said light beam across said photoreceptor;

radiation detection means for converting scattered radiation resulting from scanning developed images on said photoreceptor with said beam to image signals representative of the image scanned; and lens means for focusing said scattered radiation onto said radiation detection means.

13. The apparatus according to claim 12 in which said lens means comprises a Fresnel lens.

14. The apparatus according to claim 12 in which said radiation detection means comprises a light detecting element.

15. In a copying apparatus having a photoreceptor, said photoreceptor being comprised of a photoconductive material that is at least partially transparent, means to charge said photoreceptor in preparation for imaging, exposure means for exposing said charged photoreceptor to produce latent electrostatic images, developing means for developing said latent electrostatic images, and transfer means for transferring said developed images to copy substrate material, the improvement comprising:

a high intensity light beam;

means to focus said light beam to a spot on said photoreceptor;

scanning means astride the path of said light beam for line scanning said light beam across said photoreceptor; and image reading means for reading light transmitted through said photoreceptor when scanning images developed on said photoreceptor with said light beam to provide image signals representative of the image developed on said photoreceptor, said image reading means being disposed externally of said photoreceptor.

16. An image processing method, comprising the steps of:

(a) producing a latent electrostatic image on a charged photoconductive surface by either exposing an original at a viewing station or scanning said photoconductive surface with a flying spot beam modulated in accordance with video image signals;

(b) developing said latent electrostatic image;

(c) inhibiting transfer of said developed image to enable said developed image to be scanned;

(d) scanning said developed image with said beam while said beam is unmodulated; and (e) converting radiation from scanning said developed image with said beam to video image signals representative of the developed image scanned.

17. The image processing method according to claim 16 including the step of:

transferring said developed image to a copy substrate material following scanning of said developed image by said beam.

18. The image processing method according to claim 16 including the step of:

impinging said beam onto said photoconductive surface upstream of the point where latent electrostatic images are developed.

19. The image processing method according to claim 16 including the step of:

inhibiting cleaning of said photoconductive surface to prevent destruction of said developed image prior to scanning by said beam.

20. The method according to claim 16 including the steps of:

(a) directing said beam so that said beam impinges on said photoconductive surface at a point upstream of the point where electrostatic latent images are developed;

(b) when scanning developed images with said beam, cycling said photoconductive surface to return said developed image to the point where said beam impinges onto said photoconductive surface; and (c) inhibiting transfer of said developed image and cleaning of said photoconductive surface until after said developed image has been scanned by said beam to prevent loss of said developed image prior to scanning thereof by said beam.

21. An image processing method comprising the steps of:

(a) producing a latent electrostatic image on a charged photoconductive surface by either exposing an original at a viewing station or scanning said potoconductive surface with a flying spot beam modulated in accordance with video image signals;

(b) developing said latent electrostatic image;

(c) after developing, returning the developed image to the point where said flying spot beam impinges on said photoconductive surface to permit said beam to scan said developed image; and (d) converting radiation from scanning said developed image with said beam to video image signals representative of said developed image.

22. The image processing method according to claim 21 including the step of:

inhibiting transfer of said developed image until after said developed image has been scanned by said beam.

23. The image processing method according to claim 21 including the step of:

inhibiting cleaning of said photoconductive surface until after said developed image has been scanned by said beam.

* * * * *